United States Patent [19]

Lohmann et al.

[11] 4,129,446

[45] Dec. 12, 1978

[54] COLOR PHOTOGRAPHIC RECORDING MATERIAL

[75] Inventors: Joachim W. Lohmann, Kuerten; Otto Lapp; Gerhard Kuhn, both of Leverkusen, all of Germany

[73] Assignee: AGFA-Gevaert Aktiengesellschaft, Leverkusen, Germany

[21] Appl. No.: 797,752

[22] Filed: May 17, 1977

[30] Foreign Application Priority Data

May 21, 1976 [DE] Fed. Rep. of Germany ..... 2622922

[51] Int. Cl.[2] ..... G03C 1/76; G03C 1/84

[52] U.S. Cl. ..... 96/74; 96/84 R; 96/76 R

[58] Field of Search ..... 96/74, 84 R

[56] References Cited

U.S. PATENT DOCUMENTS

| | | | |
|---|---|---|---|
| T860,004 | 1/1969 | Graham | 96/74 |
| 2,947,628 | 8/1960 | Fierke et al. | 96/84 R |

FOREIGN PATENT DOCUMENTS

| | | | |
|---|---|---|---|
| 2530645 | 1/1976 | Fed. Rep. of Germany | 96/74 |
| 1461500 | 1/1977 | United Kingdom | 96/74 |

*Primary Examiner*—J. Travis Brown

*Attorney, Agent, or Firm*—Connolly and Hutz

[57] ABSTRACT

In a color photographic recording material comprising two red sensitive silverhalide emulsion layers of differing speed and two green sensitive silver halide emulsion layers of differing speed and a blue sensitive silver halide emulsion layer wherein each of the silver halide emulsion layers has associated with it a non-diffusing color coupler, and in which the more sensitive red sensitive silverhalide emulsion layer and the more sensitive green sensitive silver halide emulsion layer together form a comparatively more sensitive emulsion layer unit, the sensitivity for red and green light as well as for blue light is increased by placing the yellow filter layer immediately below the comparative more sensitive emulsion layer unit.

6 Claims, 1 Drawing Figure

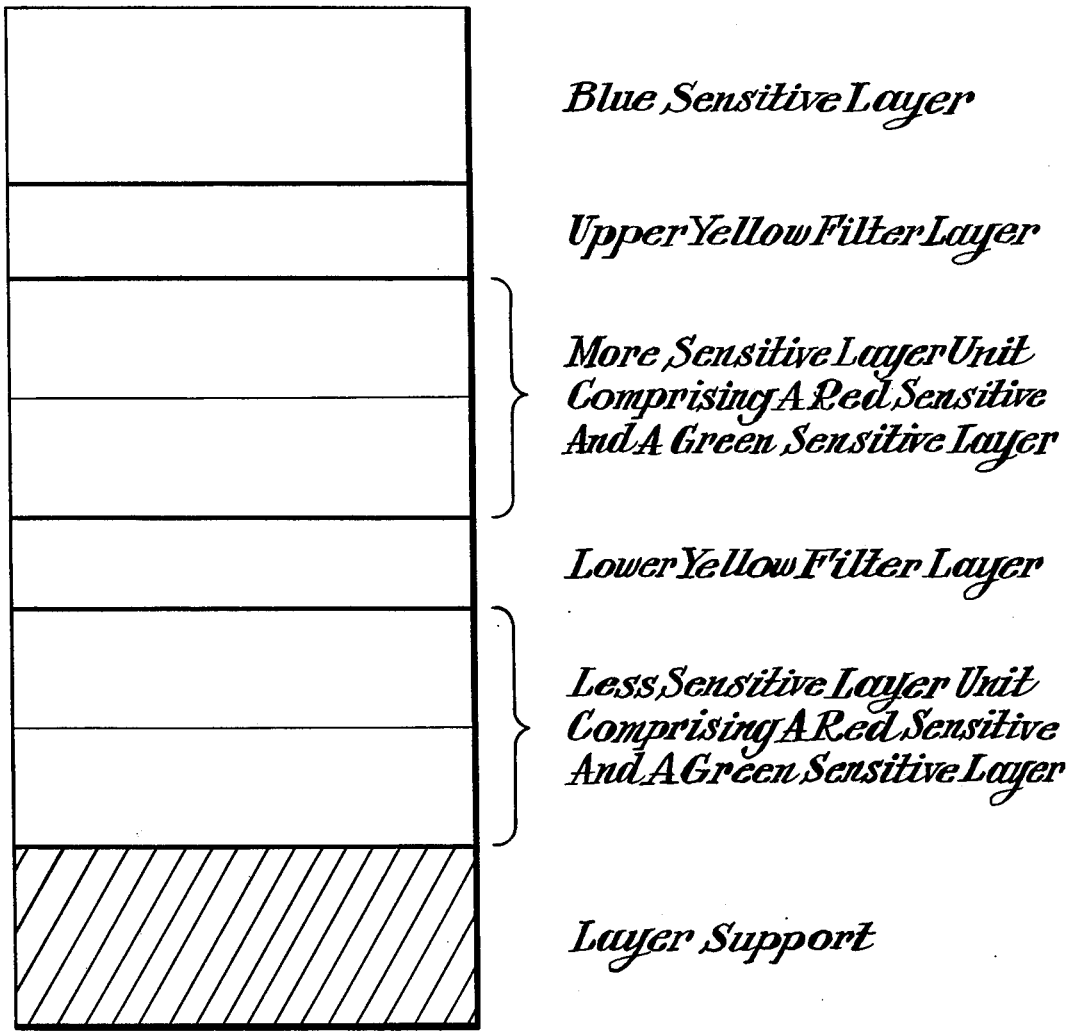
Blue Sensitive Layer
Upper Yellow Filter Layer
More Sensitive Layer Unit Comprising A Red Sensitive And A Green Sensitive Layer
Lower Yellow Filter Layer
Less Sensitive Layer Unit Comprising A Red Sensitive And A Green Sensitive Layer
Layer Support

COLOR PHOTOGRAPHIC RECORDING MATERIAL

This invention relates to a colour photographic recording material, comprising several silver halide emulsion layers, at least two of which contribute to the formation of the cyan partial colour image and at least two others to the formation of the magenta partial colour image and in which improved sensitivity is achieved by a special arrangement of the layers.

It is known to produce coloured photographic images by means of recording materials comprising a substrate carrying a red sensitive, a green sensitive and a blue sensitive silver halide emulsion layer, each of said silver halide emulsion layers, having associated with it non-diffusible colour couplers for production of the cyan, magenta and yellow partial colour image, respectively, the colour of the partial colour image produced being in each case complementary to the spectral sensitivity of the associated silver halide emulsion layer. The usual colour photographic materials contain other layers in addition, for example a yellow filter layer between the blue sensitive silver halide emulsion layer which lies on top and the green sensitive silver halide emulsion layer underneath it, as well as an antihalation layer between the substrate and the lowermost silver halide emulsion layer. Additional intermediate layers of gelatine and a covering layer may also be provided.

It is also known to use colour photographic recording materials in which at least two silver halide emulsion layers are provided for producing each of one or more of the three partial colour images. Thus, according to British Patent Specification No. 818,687, the lowermost light-sensitive colour producing layer unit of a colour photographic multilayered material consists of two partial layers containing silver halide and colour coupler and both sensitized to light of the same spectral region, the upper of these two patial layers having the greater sensitivity. German Patent Specification No. 1,121,470 discloses the use of such double layers of differing sensitivity to light of the same spectral region in which the more sensitive layer yields the lower colour density on colour development. This makes it possible to increase the sensitivity without at the same time deleteriously affecting the grainless.

Colour photographic recording materials having double layers for various spectral regions have also been disclosed in U.S. Pat. Nos. 3,663,228 and 3,849,138. Here again, the upper of the two partial layers which are sensitive to the same spectral region has the higher sensitivity. However, the layer combinations described in these Patent Specifications are intended mainly to increase the exposure latitude and there is no mention of an intention to increase the sensitivity. FIG. 1*c* of these two U.S. Patent Specifications shows a material containing two laminates which are separated from each other by a neutral grey filter and each of which consists of a red sensitive, a green sensitive and a blue sensitive silver halide emulsion layer.

This means that the two partial layers of differing sensitivity which are both sensitive to light of the same spectral region are in this case not situated adjacent to each other but in separate laminates which differ from each other in their general sensitivity, each laminate containing several silver halide emulsion layers of differing spectral sensitivity but comparable general sensitivity. Partial layers having the same spectral sensitivity are in each case separated from each other by several layers having different spectral sensitivities and by the grey filter. Another arrangement of layers which also achieves an increased exposure latitude but contains coloured filters has been disclosed in U.S. Defensive Publication No. T 860 004.

Furthermore, arrangements of layers in which red sensitive and/or green sensitive partial layers are situated above the blue sensitive silver halide emulsion layer in order to improve the sharpness of the image have been disclosed in German Offenlegungsschriften Nos. 2,453,654 and 2,453,664. These arrangements, however, are inferior in their colour reproduction and the materials are therefore only suitable when used with certain sources of light, e.g. tungsten light.

Lastly, an arrangement of layers designed to improve the sensitivity has been disclosed in German Offenlegungsschrift No. 2,530,645 according to which 1. the more sensitive of the two green sensitive silver halide emulsion layers and the more sensitive of the two red sensitive silver halide emulsion layers are situated adjacent to each other in a comparatively more sensitive emulsion layer unit;

2. the less sensitive of the two green sensitive silver halide emulsion layers and the less sensitive of the two red sensitive silver halide emulsion layers are arranged adjacent to each other in a comparatively less sensitive emulsion layer unit;

3. the less sensitive emulsion layer unit is situated closer to the layer substrate than the more sensitive emulsion layer unit;

4. in each of the two emulsion layer units, the red sensitive emulsion layer is closer to the layer substrate than the green sensitive emulsion layer and 5. the less sensitive green sensitive silver halide emulsion layer is adjacent to the more sensitive red sensitive silver halide emulsion layer.

This material thus also has two or more laminates of differing general sensitivity (different speed) and contains an alternating sequence of red sensitive and green sensitive silver halide emulsion layers.

It is an object of the present invention to provide a colour photographic recording material comprising several silver halide emulsion layers of differing spectral sensitivities, which material shows an even greater improvement in sensitivity compared with known colour photographic materials.

The invention relates to a colour photographic recording material consisting of (a) a substrate, (b) applied to this substrate, differently sensitized silver halide emulsion layers containing non-diffusible colour couplers, at least two of which emulsion layers are sensitive to red light and differ from each other in their sensitivity (speed) and at least two others are sensitive to green light and differ from each other in their sensitivity (speed), the more sensitive of the two red-sensitive and the more sensitive of the two green sensitive silver halide emulsion layers being in each case further removed from the substrate than the corresponding less sensitive silver halide emulsion layer, at least one of the silver halide emulsion layers being sensitive to blue light and each blue sensitive layer being further removed from the substrate than any of the red sensitive or green sensitive silver halide emulsion layers, and (c) at least one yellow filter layer which is closer to the substrate than the blue sensitive silver halide emulsion layer; and (d), optionally, additional layers which are not light sensitive, characterised in that the silver halide emulsion layers and the yellow filter layer are arranged on the layer substrate in such a manner that 1. the more sensitive of the two green sensitive silver halide emulsion layers and the more sensitive of the two red sensitive silver halide emulsion layers are combined to form a comparatively more sensitive emulsion layer unit;

2. the less sensitive of the two green sensitive silver halide emulsion layers and the less sensitive of the two red sensitive silver halide emulsion layers are combined to form a comparatively less sensitive emulsion layer unit; and 3. the yellow filter layer is arranged between the comparatively less sensitive emulsion layer unit comprising red sensitive and green sensitive silver halide emulsion layers and the comparatively more sensitive emulsion layer unit comprising red sensitive and green sensitive silver halide emulsion layers. When the colour photographic recording material according to the invention is exposed to light, the light first passes through the blue sensitive silver halide emulsion layer, then through the comparatively more sensitive emulsion layer unit consisting mainly of the more sensitive green sensitive silver halide emulsion layer and the more sensitive red sensitive silver halide emulsion layer, and thereafter through the yellow filter layer underneath this unit and finally enters the comparatively less sensitive emulsion layer unit consisting of a less sensitive red sensitive silver halide emulsion layer and a less sensitive green sensitive silver halide emulsion layer. In this last mentioned emulsion layer unit, the green sensitive silver halide emulsion layer is preferably situated above the red sensitive silver halide emulsion layer.

In the comparatively more sensitive emulsion layer unit, the red sensitive silver halide emulsion layer may be situated either above or below the corresponding green sensitive silver halide emulsion layer.

The FIGURE shows a sequence of layers according to this invention in which a layer support 10 and applied in sequence to this support a less sensitive red-sensitive layer 11, a less sensitive green-sensitive layer 12, a yellow filter layer 13, a higher sensitive red-sensitive layer 14, a higher sensitive green-sensitive layer 15, a yellow filter layer 16 and a blue-sensitive layer 17.

According to a particular embodiment of the invention in addition to the first yellow filter layer, which is situated between the comparatively more sensitive and the comparatively less sensitive emulsion layer unit, the colour photographic recording material has a second yellow filter layer situated between the comparatively more sensitive emulsion layer unit and the blue sensitive silver halide emulsion layer.

The following sequence of layers (from above downwards) is a characteristic arrangement of layers according to the invention:

blue sensitive silver halide emulsion layer, yellow filter layer (optional), comparatively more sensitive emulsion layer unit consisting of more sensitive red sensitive silver halide emulsion layer and more sensitive green sensitive silver halide emulsion layer, yellow filter layer, comparatively less sensitive emulsion layer unit consisting of less sensitive red sensitive silver halide emulsion layer and less sensitive green sensitive silver halide emulsion layer.

According to the invention, therefore, the yellow filter layer normally provided in layer combinations has been shifted at least partly below the layers of the comparatively more sensitive emulsion layer unit. This results in a considerable increase in sensitivity, not only in the red sensitive and green sensitive colour layers but surprisingly also in the blue sensitive colour layer. Colour reproduction is admittedly impaired but the smaller the exposure latitude covered by the more sensitive layer and the smaller the proportion of the blue light used for exposure, the slighter is this effect on colour reproduction.

To obtain a still greater increase in sensitivity, it is found advantageous to arrange an additional layer containing a relatively fine grained silver halide of comparatively very low sensitivity adjacent to one or both light sensitive silver halide emulsion layers of the comparatively more sensitive emulsion layer unit. Such an additional layer may be situated anywhere within the comparatively more sensitive emulsion layer unit, either below, above or between the more sensitive red sensitive and green sensitive silver halide emulsion layers. The silver halide used in these fine grained, relatively insensitive silver halide emulsion layers is preferably silver chloride, silver bromide or mixtures thereof having an average particle size of less than 0.1 μm.

Instead of providing a single blue sensitive silver halide emulsion layer in the colour photographic recording material according to the invention, two or more blue sensitive silver halide emulsion layers may be provided in known manner, but these must always be situated adjacent to each other.

The colour photographic recording material according to the invention may contain auxiliary layers which are insensitive to light in addition to the layers already mentioned above, for example adhesive layers, antihalation layers or covering layers, in particular intermediate layers between the light-sensitive layers to prevent diffusion of developer oxidation products from one layer to another. Furthermore, to prevent such diffusion, these intermediate layers may contain certain compounds capable of reacting with developer oxidation products. These layers are preferably arranged between adjacent light-sensitive layers of differing spectral sensitivities.

As already mentioned above, the colour photographic recording material according to the invention contains two light-sensitive partial layers of differing sensitivity for producing each partial colour image at least for producing the cyan partial colour image and the magenta partial colour image. What is important is not the absolute sensitivity but the effective sensitivity, taking into account the particular position within the multi-layered colour photographic material. The absolute sensitivity is the sensitivity of an individual layer if determined separately, that is in absence of other layers. The effective sensitivity of a light sensitive layer within a multilayer colour photographic element may be somewhat lower due to absorption of certain amounts to exposure light in upper layers. For sake of clarification, instead of the term "general sensitivity" in contrast to "spectral sensitivity" there can also be used, and is used within the context of this application, the term "speed." The difference between the effective sensitivities (speed) is suitable between 0.2 to 1.0 relative log I.t units. For each individual case, the sensitivity difference is chosen so that colour photographic processing subsequently results in a balanced gradation curve without perceptible distortion. The components of the more highly sensitive layer are suitably calculated to produce a lower colour density on colour development than that obtained in the less sensitive layer. This can be achieved by reducing the amount of silver applied and/or by altering the coupler/silver ratio.

Associated with each of the above mentioned light-sensitive silver halide emulsion layers is a colour coupler which is capable of reacting with colour developer oxidation products to form a non-diffusible dye. These colour couplers are preferably also non-diffusible and situated in the light-sensitive layer itself or in a layer closely adjacent thereto.

The colour couplers associated with the two partial layers which have the same spectral sensitivity need not necessarily be the same provided that they give rise to substantially the same colour on colour development, normally a colour which is complementary to the colour of the light to which the light sensitive silver halide emulsion layers are sensitive. The red sensitive silver halide emulsion layers therefore have associated with them at least one non-diffusible colour coupler each for the production of the cyan partial colour image, generally a coupler based on phenol or α-naphthol. The green sensitive silver halide emulsion layers each contain at least one non-diffusible colour coupler for producing the magenta partial colour image, usually a colour coupler based on 5-pyrazolone or indazolone. The blue sensitive silver halide emulsion layers contain each at least one non-diffusible colour coupler for producing the yellow partial colour image, generally a colour coupler having an open chain ketomethylene grouping. Colour couplers of these kinds are known in large number and have been described in numerous patent specifications. References may be found, for example, in "Farbkuppler" published by W. Pelz in "Mitteilungen aus den Forschungslaboratorien der Agfa, Leverkusen/München," Volume III, 111 (1961) and in the publication by K. Venkataraman in "The Chemistry of Synthetic dyes," Vol. 4, 341 to 387 Academic Press (1971).

The colour couplers may either be the usual 4-equivalent couplers or they may be 2-equivalent couplers which require a smaller quantity of silver halide for colour production. 2-Equivalent couplers are derived, as is known, from 4-equivalent couplers in that they contain in the coupling position a substituent which is split off in the coupling reaction. 2-Equivalent couplers which may be used according to the invention include both couplers which are practically colourless and couplers which have an intense colour of their own which disappears during the colour coupling reaction and is replaced by the colour of the image dye produced. According to the invention, the last mentioned couplers may in addition be present in the light-sensitive silver halide emulsion layers, where they serve as masking couplers to compensate for unwanted side densities of the image dyes. Suitable 2-equivalent couplers also include the known white couplers, but these do not yield a dye in their reaction with colour developer oxidation products. The 2-equivalent couplers also include the known DIR couplers, which are couplers which contain a removable group in the coupling position, which group is released as a diffusible development inhibitor by the reaction with colour developer oxidation products.

Mixtures of colour couplers may be used as required to obtain a desired colour shade or desired reactivity. Water-soluble couplers, for example, may be used in combination with hydrophobic, water insoluble couplers.

Whereas the water-soluble couplers are in most cases added to the emulsion in the form of aqueous alkaline solutions, the hydrophobic couplers are suitably incorporated by means of one of the known emulsification processes in which, for example, the coupler is dissolved in an organic solvent, optionally in the presence of a high boiling coupler solvent, and is then dispersed in a gelatine solution. Dibutylphthalate and tricresylphosphate are examples of high boiling coupler solvents. Other coupler solvents have been described, for example, in U.S. Pat. Nos. 2,322,027; 3,689,271; 3,764,336 and 3,765,897.

It is also possible to prepare aqueous dispersions of the hydrophobic couplers and add them to the casting solutions. For this purpose, aqueous suspensions of the couplers are finely milled, for example by vigorous stirring with the addition of sharp sand and/or by means of ultrasound in the absence of substantial amounts of organic solvents. Reference may be had in this connection to German Patent Application P 26 09 741.6.

Preferably at least one silver halide emulsion layer in the comparatively less sensitive emulsion layer unit contains a non-diffusible compound which is capable of reacting with colour developer oxidation products to release a diffusible development inhibitor. The silver halide emulsion layers of the comparatively more sensitive emulsion layer unit may also contain such a non-diffusible compound capable of releasing a diffusible development inhibitor in its reaction with developer oxidation products. Compounds which release development inhibitors include, for example, the known DIR couplers which are 2-equivalent colour couplers which release a diffusible development inhibitor in the colour coupling reaction, a dye being formed at the same time from the coupler molecule. Such DIR couplers have been described, for example, in U.S. Pat. No. 3,227,554.

It is particularly preferred, however, to use development inhibitor releasing compounds which react with colour developer oxidation products to release a development inhibitor without at the same time forming a dye. Compounds of this kind, which may be referred to as DIR compounds in contrast to DIR couplers, have been described, for example, in U.S. Pat. No. 3,632,345. In this connection, reference may also be made to German Offenlegungsschriften Nos. 2,362,752; 2,359,295; 2,405,442; 2,448,063 and 2,529,350.

The intermediate layers arranged between the light-sensitive silver halide emulsion layers, in which intermediate layer the binder is preferably gelatine, may contain compounds which are capable of reacting with colour developer oxidation products and which thus prevent unwanted diffusion of the colour developer oxidation products. Examples of such compounds include non-diffusible reducing agents such as hydroquinone derivatives, or couplers which, when they react with colour developer oxidation products, do not yield a dye which remains in the layers. The white couplers already mentioned above are particularly suitable for this purpose but so also are colour couplers yielding a soluble dye which is washed out of the layers during colour photographic processing. Other suitable compounds for suppressing unwanted diffusion of colour developer oxidation products have been described, for example, in the monograph "Stabilization of Photographic Silver Halide Emulsion" by E. J. Birr, The Focal Press, 1st Edition 1974, pages 116 to 122.

Information on other suitable additives for the colour photographic recording material according to the invention or for one of its layers may be found in the article printed in "Product Licensing Index," Volume 92, December 1971, pages 107 to 110.

The photographic materials according to the invention may be developed with the usual colour developer compounds, in particular those based on p-phenylenediamine and which have a primary amino group, e.g. 4-amino-N,N-dimethylaniline; 4-amino-N,N-diethylaniline; 4-amino-3-methyl-N,N-diethylaniline; 4-amino-3-methyl-N-methyl-N-(β-methylsulphonamidoethyl)-aniline, 4-amino-N-ethyl-N-(β-hydroxyethyl)-aniline; 4-amino-3-methyl-N-ethyl-N-(β-hydroxyethyl)-aniline; 4-amino-3-methyl-N-ethyl-N-(β-methoxyethyl)-aniline; 4-amino-3-methyl-N-ethyl-N-(β-methyl-sulphonamidoethyl)-aniline; 4-amino-N-butyl-N-(ω-sulphobutyl)-aniline; and 4-amino-3-methyl-N-isopropyl-N-(ω-sulphobutyl)-aniline.

Other suitable colour developers have been described, for example, in J.Amer.Chem.Soc. 73, 3100–3125 (1951).

EXAMPLE 1

The following layers were applied in succession to a transparent substrate carrying an antihalation layer. The quantities given refer to 1 $m^2$. The quantities of silver applied are given in terms of the corresponding quantities of silver nitrate.

1. A less sensitive red sensitive layer containing a red sensitised silver iodobromide emulsion (5 mol % of silver iodide) of 2.25 g of silver nitrate and 700 mg of a cyan coupler of the formula

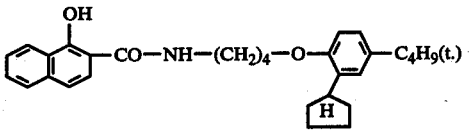

20 mg of a DIR coupler of the formula

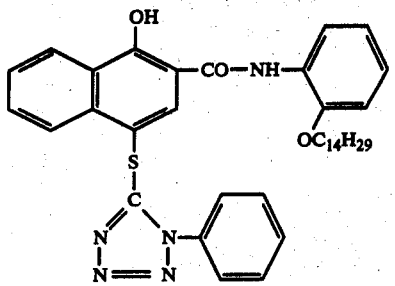

and 1.4 g of gelatine.

2. An intermediate layer of 0.7 g of gelatine.

3. A less sensitive green sensitive layer containing a green sensitized mixture of a relatively sensitive silver iodobromide emulsion (5 mol % of silver iodide) of 1.5 g of silver nitrate and a relatively insensitive silver iodobromide emulsion (5 mol % of silver iodide) of 1.9 g of silver nitrate with 550 mg of a magenta coupler of the formula

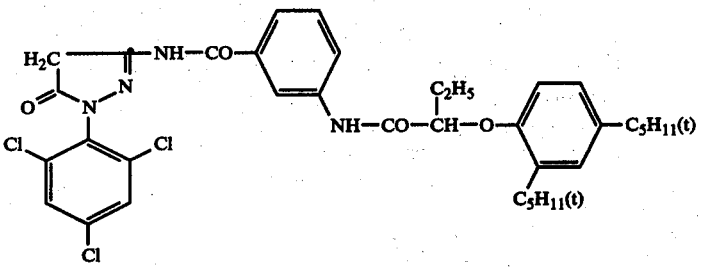

55 mg of a DIR coupler of the formula

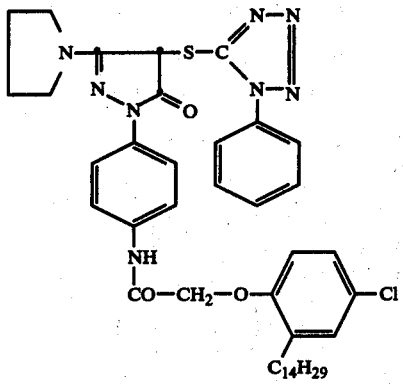

73 mg of a masking coupler of the formula

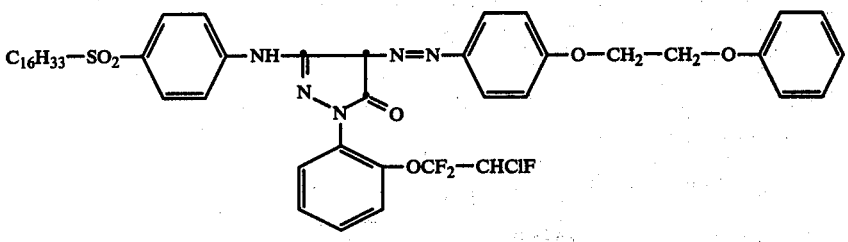

and 1.8 g of gelatine.

4. An intermediate layer containing 0.7 g of gelatine.

5. A yellow filter layer as described in the following table.

6. A high sensitivity red sensitive layer containing a red sensitised silver iodobromide emulsion (5 mol % silver iodide) of 2.0 g of silver nitrate and 250 mg of the cyan coupler of layer 1.

7. A layer containing an insensitive silver chloride emulsion of 350 mg of silver nitrate and 0.7 g of gelatine.

8. A high sensitive green sensitive layer containing a green sensitized silver iodobromide emulsion (7 mol % silver iodide) of 2.8 g of silver nitrate and 170 mg of a magenta coupler of the formula

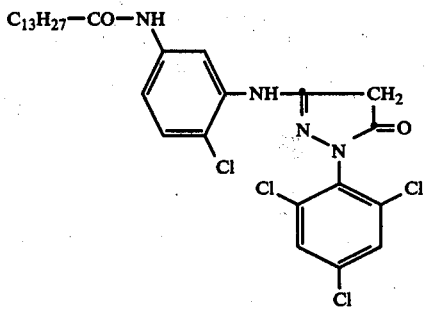

37 mg of a magenta coupler of the formula

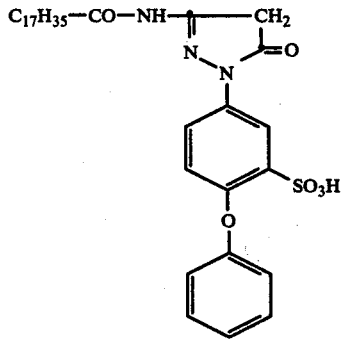

and 2.1 g of gelatine.

9. An intermediate layer containing 0.7 g of gelatine.

10. A second yellow filter layer as indicated in the following table.

11. A blue sensitive layer containing a mixture of a relatively sensitive silver iodobromide emulsion (2 mol % silver iodide) and 1.0 g of silver nitrate and a relatively insensitive silver iodobromide emulsion (3 mol % silver iodide) of 0.6 g of silver nitrate and 1.5 g of a yellow coupler of the formula

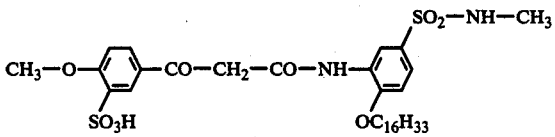

and 2.0 g of gelatine.

12. A top coating layer containing 0.7 g of gelatine.

Five layer combinations were prepared which differed from each other only in the filter density of the first and second yellow filter layer, as can be seen from the following table. The table also gives the sensitivities in relatively log I.t units measured at 0.2 above fog for the three partial colour images obtained after processing by the method described in the British Journal of Photography, July 1974, pages 597 and 598.

Table 1

| | Yellow filter density | | Sensitivity [rel.log I.t] | | |
|---|---|---|---|---|---|
| Combination | Layer 5 | Layer 10 | Yellow | Magenta | Cyan |
| I | 0.0 | 0.8 | 4.12 | 3.91 | 3.80 |
| II | 0.2 | 0.6 | 4.15 | 3.95 | 3.80 |
| III | 0.4 | 0.4 | 4.20 | 3.99 | 3.80 |
| IV | 0.6 | 0.2 | 4.25 | 4.09 | 3.86 |
| V | 0.8 | 0.0 | 4.33 | 4.23 | 3.99 |

As can be seen from the table, there is a marked increase in sensitivity in all three colours with decreasing filter density in layer 10. Colour reproduction is slightly impaired in combinations IV and V. This deleterious effect on colour reproduction is all the slighter the smaller the exposure latitude of the more sensitive layer and the smaller the proportion of blue in the light used for exposure.

EXAMPLE 2

When layers 1 and 3 are interchanged in the combinations of Example 1, the results shown in Table 2 are obtained.

Table 2

| | Yellow filter density | | Sensitivity [rel. log I.t] | | |
|---|---|---|---|---|---|
| Combination | Layer 5 | Layer 10 | Yellow | Magenta | Cyan |
| I | — | 0.8 | 4.23 | 3.80 | 3.59 |
| II | 0.2 | 0.6 | 4.23 | 3.85 | 3.58 |
| III | 0.4 | 0.4 | 4.24 | 3.92 | 3.59 |
| IV | 0.6 | 0.2 | 4.28 | 4.00 | 3.60 |
| V | 0.8 | — | 4.35 | 4.15 | 3.72 |

Combination V provides a distinct increase in sensitivity in all three colour layers, compared with combination I. Here again, this is associated with a desaturation of the colours in the positive. In combinations II, III and IV, the increase in sensitivity is less and colour reproduction therefore better.

We claim:

1. The color photographic recording material consisting of (a) a layer support having applied to it a plurality of light-sensitive and non-light-sensitive layers including (b) at least two red sensitive silver halide emulsion layers of different speed each having associated with it a non-diffusing cyan-forming coupler, at least two green sensitive silver halide emulsion layers of different speed each having associated with it a non-diffusing magenta-forming coupler, and one or more blue sensitive silver halide emulsion layers each of said one or more blue sensitive layers having associated with it a non-diffusing yellow-forming coupler, and being located further removed from the layer support than anyone of said red sensitive and green sensitive layers, and (c) at least one non-light-sensitive yellow filter layer located closer to the layer support than any of said one or more blue sensitive layers, the more sensitive of said red sensitive layers and the more sensitive of said green sensitive layers being combined to form a comparatively more sensitive emulsion layer unit which is located further removed from the layer support than the less sensitive of said red sensitive layers and the less sensitive of said green sensitive layers being combined to form a comparatively less sensitive emulsion layer unit wherein the improvement comprises a yellow filter layer is located between said more sensitive emulsion layer unit and said less sensitive emulsion layer unit and said yellow filter being more adjacent to the layer support than said comparatively more sensitive emulsion layer unit, and said yellow filter is not adjacent to a blue sensitive layer.

2. Recording material as claimed in claim 1, in which an additional yellow filter layer is located closer to the layer support than said one or more of the blue sensitive silver halide emulsion layers and further removed from the layer support than said comparatively more sensitive emulsion layer unit.

3. Recording material as claimed in claim 1, in which two blue sensitive silver halide emulsion layers of differing speed are arranged adjacent to each other above the comparatively more sensitive emulsion layer unit.

4. Recording material as claimed in claim 1, in which at least one silver halide emulsion layer in the comparatively less sensitive emulsion layer unit contains a non-diffusing compound which, in its reaction with color developer oxidation products, is capable of releasing a diffusing silver halide development inhibitor.

5. Recording material as claimed in claim 1, in which within the comparatively less sensitive emulsion layer unit the green sensitive silver halide emulsion layer is arranged above the red sensitive silver halide emulsion layer.

6. Recording material as claimed in claim 5, in which within the more sensitive emulsion layer unit the green sensitive silver halide emulsion layer is arranged above the red sensitive silver halide emulsion layer.

* * * * *